United States Patent [19]

Hazard

[11] 3,957,181

[45] May 18, 1976

[54] CHILD RESISTANT DISPENSING CLOSURE

[75] Inventor: Robert E. Hazard, North Kingstown, R.I.

[73] Assignee: Polytop Corporation, Slatersville, R.I.

[22] Filed: Feb. 13, 1975

[21] Appl. No.: 549,720

[52] U.S. Cl. ..... 222/534; 222/536; 222/538

[51] Int. Cl.[2] ..... B65D 25/46

[58] Field of Search ..... 222/153, 536, 531–534, 222/538, 556

[56] References Cited

UNITED STATES PATENTS

| | | | |
|---|---|---|---|
| 3,094,256 | 6/1963 | Ensch | 222/536 |
| 3,542,256 | 11/1970 | Waterman | 222/536 X |
| 3,702,165 | 11/1972 | Carow et al. | 222/153 |
| 3,718,238 | 2/1973 | Hazard et al. | 222/536 |
| 3,784,060 | 1/1974 | Hazard | 222/153 |
| 3,851,805 | 12/1974 | Hazard | 222/536 X |

FOREIGN PATENTS OR APPLICATIONS

| | | | |
|---|---|---|---|
| 1,342,589 | 9/1963 | France | 222/531 |
| 688,825 | 6/1964 | Canada | 222/536 |

*Primary Examiner*—Drayton E. Hoffman
*Assistant Examiner*—Charles A. Marmor
*Attorney, Agent, or Firm*—Edward D. O'Brian

[57] ABSTRACT

A child resistant dispensing closure can be constructed by modifying a known type of cap and a known type of spout so that the spout fits entirely within an elongated groove in the cap when the spout is in a closed position. When the spout is in such a position the end of the spout which is normally engaged to move the spout between opened and closed positions is located within this groove in the top of the cap facing the interior of a part of the skirt. This part of the skirt is preferably separated from the remainder of the skirt by slits leading from the top of the cap along opposed sides of the part. This part is capable of being temporarily distended by manual manipulation so as to permit spout movement. Preferably such spout movement is initiated by applying pressure to a portion of the spout remote from the noted end of the spout.

5 Claims, 4 Drawing Figures

CHILD RESISTANT DISPENSING CLOSURE

CROSS REFERENCE TO RELATED APPLICATIONS

This application contains subject matter which to a degree is related to the subject matters of the following copending U.S. patent applications:

Hazard application Ser. No. 307,516, filed Nov. 17, 1972, entitled, "Child Resistant Closure", now U.S. Pat. No. 3,884,392, issued May 20, 1975.

Hazard application Ser. No. 425,227, filed Nov. 17, 1973, entitled, "Dispensing Closure With Integral Spout Latches", now U.S. Pat. No. 3,863,818, issued Feb. 4, 1975.

Hazard application Ser. No. 326,425, filed Jan. 24, 1973, entitled, "Child Resistant Closures With Limited Spout Accessibility", now U.S. Pat. No. 3,851,805, issued Dec. 3, 1974.

The entire disclosures of these co-pending applications are incorporated herein by reference.

CROSS REFERENCE TO RELATED PATENTS

This application contains subject matter which is related to the subject matters of the following U.S. patents:

Hazard U.S. Pat. No. 3,655,099, issued Apr. 11, 1972, entitled "Rotatable Spout Closures With Latch Structures";

Hazard U.S. Pat. No. 3,655,103, issued Apr. 11, 1972, entitled "Safety Dispensing Closures";

Hazard et al. U.S. Pat. No. 3,718,238, issued Feb. 27, 1973, entitled "Safety Dispensing Closure";

Hazard U.S. Pat. No. 3,776,428, issued Dec. 4, 1973, entitled "Safety Closure Usable On Threaded Container Neck"; and Hazard U.S. Pat. No. 3,784,060, issued Jan. 8, 1974, entitled "Child Resistant Deformable Closure".

In addition, the subject matter of this application is related to the subject matters of a large number of other issued patents, none of which are considered to be more pertinent than the patents noted herein.

BACKGROUND OF THE INVENTION

The invention set forth in this specification pertains to new and improved child resistant dispensing closures.

The term "dispensing closure" is commonly utilized to designate two-part closures employing a cap and a spout. Such closures are normally constructed so that the spout is rotatably mounted on the cap in such a manner as to be capable of being rotated between an opened position in which a passage through the spout is in communication with an opening through the top of the cap and a closed position in which the spout closes off the opening through the cap. Such dispensing closures may be constructed in a number of different manners.

In the past many of such closures have been constructed so as to utilize flat tops and spouts which lie within grooves in such tops in order to facilitate containers utilizing such closures being stacked on one another. Such "flat top" closures have been constructed in such a manner as to permit manual access to their spouts in order to permit the spouts to be engaged when they are in a closed position so as to be rotated to an opened position. Frequently such closures have been constructed in such a manner that the ends of the passages in their spouts are closed off by walls within the cap so as to prevent any material which may be located within such passages from drying out by contact with ambient air.

The term "child resistant" is being increasingly utilized in the closure field so as to designate closures which are sufficiently difficult to open so that at least in theory comparatively young children are not apt to open them but which nevertheless are sufficiently easy to open so that the average adult can open them when necessary. The dispensing closure industry has been faced with a significant problem in providing dispensing closures which are child resistant in character. Various attempts have been made to solve this problem in various ways by various different types of dispensing closures.

An understanding of the invention is not considered to require an understanding of all of the various different types of child resistant dispensing closures which have been proposed and to varying extents adopted. However, it is believed that it will be useful in understanding the invention to briefly review the efforts which have been made to provide flat top dispensing closures of a child resistant category. Various known flat top child resistant closures have been constructed so as to employ detents or detent type structures intended to make the spouts in said closures relatively difficult to open. Closures of this type have not been considered to be sufficiently child resistant in character to be acceptable from a commercial standpoint.

It has also been proposed to construct so-called flat top dispensing closures employing various types of latches and similar structures to make these closures relatively difficult to open. Although prior dispensing closures of these types are considered to be utilitarian and satisfactory it is considered that there is a need for new and improved child resistant dispensing closures which are desirable from a number of aspects. More specifically, it is considered that there is a need for closures of this type which are effective from a child resistant viewpoint, which are desirable from an aesthetic and a utilitarian standpoint, and which can be constructed with a minimum of redesign of existing closures so as to minimize the costs of these closures.

SUMMARY OF THE INVENTION

A broad object of the invention is to provide new and improved child resistant dispensing closures. A related, broad objective of the invention is to provide dispensing closures which fulfill the need indicated in the preceding discussion. Other objects of the present invention are to provide child resistant dispensing closures which can be manufactured at a comparatively nominal cost, which are based upon prior dispensing closures to a sufficient extent so that no significant redesign is necessary in connection with the manufacture, which are of a flat top variety so as to be desirable from aesthetic and utilitarian viewpoints, and which are capable of performing satisfactorily over a prolonged period.

The closures of the present invention are constructed so as to include a cap and a spout. The cap in a closure of this invention includes a peripheral skirt which is adapted to be attached to a container, a top enclosing one end of the skirt and an elongated groove located within the top, one end of the groove being located facing the interior of a part of the skirt, the cap having an opening leading through the top into the groove. The spout is an elongated member having a passage extending between its ends, one of which ends is rotatably mounted on the top so that the other end is capable of being manipulated between a closed position in which the opening in the cap is closed off and an opened position in which the passage through the spout is aligned with the opening.

A dispensing closure of the invention involves improving such a closure by forming the spout and the cap so that the spout fits in the groove in the cap when it is in a closed position so that the spout is incapable of being manually engaged, as, for example, by being grasped by parts of the hand or engaged by a part of the hand so as to move it from the closed position to the opened position. Means are formed on the spout adjacent to where it is rotatably mounted so that pressure may be applied to the spout, as, for example, through the use of a pencil or similar instrument or a part of the finger to pivot the spout to such an extent that the other end is capable of being manipulated by the hand so as to continue to rotate the spout to an open position. Preferably means are provided on the skirt of the cap facilitating flexure of the noted part of the skirt, and this part of the skirt is formed with a flange 54 or similar means which has to be moved away from the skirt so that the spout can be rotated from its closed position.

BRIEF DESCRIPTION OF THE DRAWING

Further details of the present invention are best explained with reference to the accompanying drawing in which.

Figure 1:
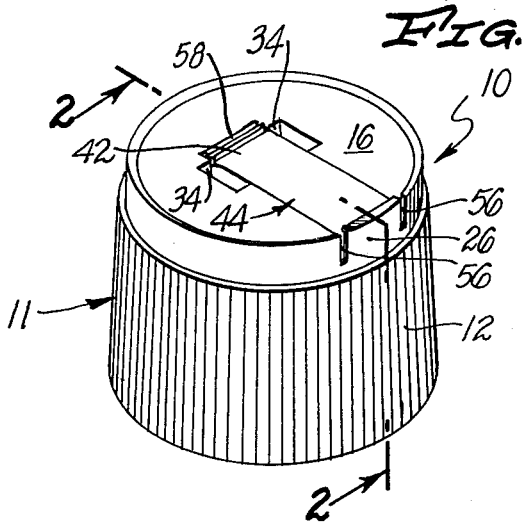
FIG. 1 is an isometric view of a presently preferred embodiment or form of a child resistant dispensing closure in accordance with this invention.
Figure 3:
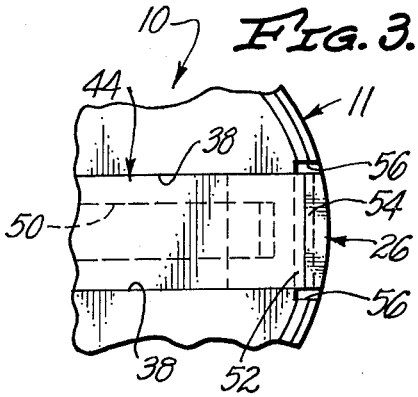
FIG. 3 is a partial top plan view of the closure shown in FIG. 1.

The illustrated dispensing closures embody the features or principles of the invention defined and/or summarized in the appended claims. In considering the particular closures illustrated it should be kept in mind that these features or principles can be embodied within somewhat differently constructed and differently appearing dispensing closures through the use of routine engineering and design skill in the dispensing closure industry.

DETAILED DESCRIPTION

In the initial figures of the drawing there is shown a child resistant dispensing closure 10 in accordance with this invention having a cap 11 which includes a peripheral skirt 12 terminating in an upper edge 14 which is enclosed by a top 16. A conventional "means" such as a bead 18 is preferably utilized within the interior 20 of the skirt 12 for attaching the skirt 12 to a conventional container (not shown) in an established manner. Preferably a conventional generally cylindrical plug 22 is located so as to depend from the top 16 concentrically within the skirt 12 as an aid to forming a seal with such a container.

The top 16 in the closure 10 is of a substantially flat configuration. It is provided with an elongated groove 24 extending from within the central region of the top

Figure 2:
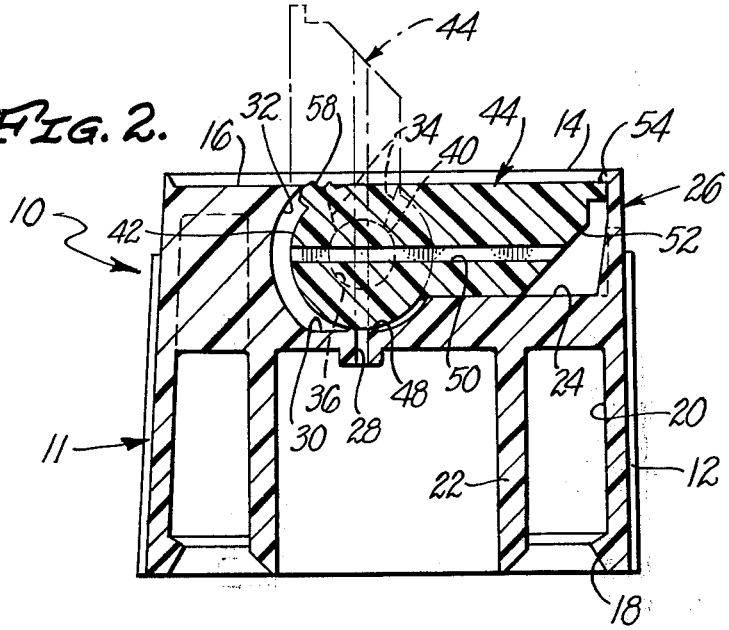
FIG. 2 is a cross-sectional view taken at line 2—2 of FIG. 1.

16 to adjacent to the interior 20 of the skirt 12 where this groove 24 terminates adjacent to a part 26 of this skirt 12. An opening 28 is located in the top 16 so as to lead from within the skirt 12 through the top 16 into the bottom 30 of an enlarged end 32 of the groove 24. Preferably this top 16 is provided with sloping walls 34 leading to bearing cavities 36 located on opposed sides 38 of the groove 24. These walls 34 are designed so that conventional trunions 40 extending from a first or base end 42 of an elongated spout 44 may be snapped into place in the bearing cavities 36 in such a manner that the spout 44 may be rotated between a closed position as shown in FIG. 1 and 2 and an opened position in which the spout 44 extends as indicated in phantom in FIG. 2.

During such rotation a cylindrical surface 46 on the end 42 continuously bears against a sealing ring 48 of known design located around the opening 28 in the bottom 30 of the end 32. This surface 46 bears against the sealing ring 48 in such a manner that a seal is maintained between the top 16 and the spout 44 at all times. When the spout 44 is in an opened position a passage 50 extending between the end 42 and the other end 52 of it is in communication with the opening 28. When the spout 44 is in a closed position this passage 50 is spaced from the opening 28 and lies generally parallel to the top 16.

When the spout 44 is in this closed position a small flange 54 on the part 26 overlies the end 52 of the spout 44 so as to prevent this end 52 from being manually engaged. It is noted that the spout 44 is also constructed so as to lie entirely within the groove 24 when it is in a closed position. This precludes manual engagement of the spout 44 so that it can be opened when it is in this closed position. Preferably the skirt 12 is formed so as to include two substantially parallel side slits 56 located along opposed sides (not separately numbered) of the part 26 generally in alignment 38 of the groove 24. These slits 56 are intended to facilitate flexure of the part 26.

When, as preferred, the cap 11 is formed of a resilient material such as a known polyolefin such as linear polyethylene this part 26 will be sufficiently resilient that it is capable of being manually engaged along the flange 54 and pulled back away from the spout 44 to a sufficient extent so that the flange 54 clears the spout 44. At this point a small enlargement 58 on the base end 42 of the spout 44 may be pushed downwardly. This will rotate the spout 44 so that it projects out of the groove 24 to a sufficient extent so that it may be manually engaged. The spout 44 may then be rotated to a completely open position as a result of such engagement.

The enlargement 58 is of such a nature that it is substantially within the groove 24 when the spout 44 is in a closed position. Thus, normally the enlargement 58 cannot be manually engaged so as to maneuver or rotate this spout 44. In the embodiment of the enlargement 58 shown the enlargement 58 is serrated so as to facilitate a finger or the like pushing upon it to rotate the spout 44 to a limited extent. If desired the enlargement 58 can include a small depression adapted to be engaged by a pencil or pen or the like so as to rotate the spout 44 to a limited amount as indicated.

It is noted that this enlargement 58 is very close to the axis of rotation of the end 42 and the spout 44. As a consequence of this more force is required to pivot the spout 44 from a completely closed position than would be required if the end 52 could be manually engaged. This is considered to be significant in achieving a desired degree of child resistance to opening. The child resistance to opening with the closure 10 is achieved because of this feature and because the part 26 must be distended as described. Thus, two separate motions are required in order to open this closure 10.

In the closure 10 the flange 54 is beveled slightly as illustrated in FIG. 2 so as to appear as a continuation of the edge 14. This configuration of the flange 54 permits the end 52 to engage the flange 54 when the spout is moved toward a closed position so as to "spring" or deflect the part 26 outwardly a sufficient extent so that the spout 44 can be moved to a completely closed position. The inherent resiliency of the part 26 will normally return this part 26 to a position as shown in FIG. 2 after it has been distended from its original position either as a result of manual manipulation or contact with the spout 44. Because of this the flange 54 will act more or less as a latch overlying the spout 44 when the spout 44 is closed in such a manner as to prevent accidental or undesired movement of this spout 44.

Figure 4:
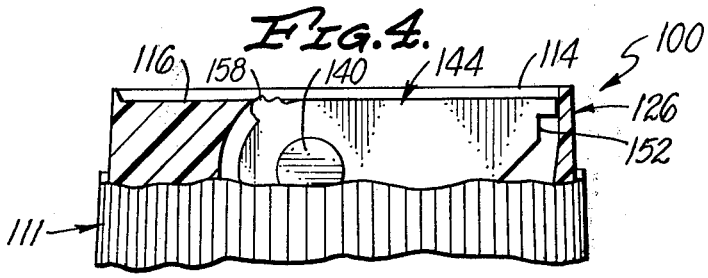
FIG. 4 is a partial side elevational view of a modified dispensing closure in accordance with this invention in which part of the closure is broken away so as to illustrate certain operative parts of the closure in cross-section.

In FIG. 4 of the drawing there is shown a modified closure 100 which is substantially identical to the closure 10 except as hereinafter indicated. For this reason various parts of the closure 100 are not separately described herein and are indicated in the drawing and where necessary for explanatory purposes in the remainder of this specification by the numerals previously used to indicate such parts preceded by the numeral one.

The closure 100 differs from the closure 10 by the omission of the flange 54 and the slits 56. In the closure 100 the part 126 is intended to fit closely enough against the end 152 so that it is impossible to insert a part of the finger or the like with respect to the end 152 so as to rotate the spout 144 to an open position or to a position in which it can be reengaged to be rotated so as to be completely open. In the closure 100 the enlargement 158 represents the sole means for use in moving the spout 144 from a completely closed position. This type of structure is considered sufficiently child resistant for many purposes.

I claim:

1. A dispensing closure having a cap and a spout, said cap including mounting means adapted to be attached to a container, a top connected to said mounting means an elongated groove having ends located within said top, one end of said groove being located adjacent to the periphery of said top, the other end of said groove being spaced from the periphery of said top, and means for rotatably supporting said spout so that said spout can be rotated about a substantially horizontal axis, said cap having an opening leading through said top into said groove adjacent to said other end of said groove, said spout being an elongated member having first and second ends and a passage extending between said ends, said spout including means for rotatably mounting said spout so that said spout can be rotated about said axis, said first end of said spout being rotatably mounted on said top by engagement of both of said means for rotatably mounting, said second end of said spout being capable of being manipulated between a closed position in which said first end of said spout closes off said opening and in which said second end is located within said groove adjacent to said first mentioned end of said groove and an opened position in which said spout extends outwardly from said groove in which said passage is aligned with said opening in which the improvement comprises:

said spout fitting within said groove when it is in said closed position to a sufficient extent so that said spout is incapable of being manually engaged so that it can be moved from said closed position to said opened position, means on said first end of said spout located on the side of said axis which is remote from said second end of said spout for use in applying a force to said first end when said spout is in said closed position so as to rotate said spout about said axis from said closed position to a sufficient extent so that said second end of said spout can thereafter be manually engaged to be moved from said closed position to said open position, said means for use in applying a force being incapable of manual engagement, and being located generally beneath the uppermost extremity of said cap.

2. A dispensing closure as claimed in claim 1 wherein:

said top is a flat top and said spout fits entirely within said groove when said spout is in said closed position so that a surface of said spout appears as a continuation of said top.

3. A dispensing closure as claimed in claim 1 wherein:

said top is surrounded by a peripheral skirt, said skirt includes two substantially parallel side slits leading from said cap located along opposed sides of said part of said skirt, said part of said skirt being integral with the remainder of said skirt along its bottom, said part of said skirt being resilient and being adapted to be physically deformed so as to extend outwardly away from said groove in order to permit access to said second end of said spout when said spout is in said closed position to said opened position, said part of said skirt being sufficiently resilient to return to its initial position after being so deformed in order to cover said second end of said spout when said spout is in said closed position.

4. A dispensing closure as claimed in claim 3 wherein:

said part of said skirt includes a flange formed on the extremity thereof adjacent to said top, said flange having a tapered wall capable of being engaged by said spout when said spout is moved to said closed position so as to deflect said part of said skirt outwardly to a sufficient extent to permit said spout to be moved to said closed position, said flange overlying said spout when said spout is in said closed position.

5. A dispensing closure as claimed in claim 1 wherein:

said top surrounded by a peripheral skirt is a flat top and said spout fits entirely within said groove when said spout is in said closed position so that a surface of said spout appears as a continuation of said top, said skirt includes two substantially parallel side slits leading from said top of said cap located along opposed sides of said part of said skirt, said part of said skirt being integral with the remainder of said skirt along its bottom, said part of said skirt being resilient and being adpated to be physically deformed so as to extend outwardly away from said groove in order to permit access to said second end of said spout when said spout is in said closed position to said opened position, said part of said skirt being sufficiently resilient to return to its initial position after being so deformed in order to cover said second end of said spout when said spout is in said closed position, said part of said skirt includes a flange formed on the extremity thereof adjacent to said top, said flange having a tapered wall capable of being engaged by said spout when said spout is moved to said closed position so as to deflect said part of said skirt outwardly to a sufficient extent to permit said spout to be moved to said closed position, said flange overlying said spout when said spout is in said closed position.

* * * * *

UNITED STATES PATENT OFFICE

CERTIFICATE OF CORRECTION

PATENT NO. : 3,957,181

DATED : MAY 18, 1976

INVENTOR(S) : ROBERT E. HAZARD

It is certified that error appears in the above-identified patent and that said Letters Patent are hereby corrected as shown below:

Column 4, line 38, "alignment 38" should read --alignment with the sides 38--.

Column 6, line 31, "leading from said cap" should read --leading from said top of said cap--.

Column 6, line 66, "adapted" is misspelled.

Signed and Sealed this

Ninth Day of November 1976

[SEAL]

*Attest:*

RUTH C. MASON
*Attesting Officer*

C. MARSHALL DANN
*Commissioner of Patents and Trademarks*